US008312572B2

(12) United States Patent
Heffner

(10) Patent No.: US 8,312,572 B2
(45) Date of Patent: Nov. 20, 2012

(54) TELESCOPING PLUMBING DEVICE AND METHOD

(75) Inventor: Robert Scott Heffner, Vista, CA (US)

(73) Assignee: Robert Scott Heffner, Vista, CA (US)

( * ) Notice: Subject to any disclaimer, the term of this patent is extended or adjusted under 35 U.S.C. 154(b) by 1447 days.

(21) Appl. No.: 11/867,664

(22) Filed: Oct. 4, 2007

(65) Prior Publication Data

US 2008/0083058 A1 Apr. 10, 2008

Related U.S. Application Data

(60) Provisional application No. 60/828,367, filed on Oct. 5, 2006.

(51) Int. Cl.
*E03D 9/00* (2006.01)

(52) U.S. Cl. ..... 4/255.01

(58) Field of Classification Search ..... 4/255.01, 4/255.07, 255.08

See application file for complete search history.

(56) References Cited

U.S. PATENT DOCUMENTS

| | | | | |
|---|---|---|---|---|
| 275,876 | A | | 4/1883 | Abbott |
| 566,110 | A | | 8/1896 | Wrigley |
| 1,817,015 | A | | 8/1931 | Miller |
| 1,851,766 | A | * | 3/1932 | Hotchkiss, Jr. ..... 15/104.33 |
| 2,061,553 | A | | 11/1936 | Acosta |
| 2,413,997 | A | | 1/1947 | Rosa |
| 2,755,810 | A | | 7/1956 | Kurt |
| 3,062,152 | A | | 11/1962 | Huff, Sr. |
| 3,075,535 | A | | 1/1963 | Lasting |
| 3,537,113 | A | | 11/1970 | Elzner |
| 3,595,255 | A | | 7/1971 | Mulinex |
| 3,608,098 | A | * | 9/1971 | Andrisani ..... 4/255.04 |
| 3,672,380 | A | | 6/1972 | Schuster |
| 3,714,951 | A | | 2/1973 | Lundman |
| 3,792,708 | A | | 2/1974 | Tash |
| 3,802,449 | A | | 4/1974 | Mulinex |
| 3,840,033 | A | | 10/1974 | Warsinger |
| 3,937,404 | A | | 2/1976 | Johnson |
| 3,952,341 | A | | 4/1976 | Cain |
| 3,994,032 | A | | 11/1976 | Spickofsky |
| 4,053,955 | A | | 10/1977 | Canham |
| 4,096,597 | A | | 6/1978 | Duse |
| 4,097,937 | A | | 7/1978 | Hofmann |
| 4,137,578 | A | | 2/1979 | Felici |
| 4,144,598 | A | | 3/1979 | Li |
| 4,174,548 | A | | 11/1979 | Dunn |
| 4,238,860 | A | | 12/1980 | Dixon |
| 4,320,539 | A | | 3/1982 | Li |
| 4,354,515 | A | | 10/1982 | Sutherland |
| 4,358,861 | A | | 11/1982 | Sard |
| 4,364,140 | A | * | 12/1982 | Irwin ..... 15/104.33 |
| 4,447,917 | A | | 5/1984 | Walter |
| 4,460,019 | A | | 7/1984 | Condon |
| 4,475,255 | A | | 10/1984 | Tash |
| 4,542,543 | A | | 9/1985 | Irwin |
| 4,606,364 | A | | 8/1986 | Tash |

(Continued)

*Primary Examiner* — Lori Baker
(74) *Attorney, Agent, or Firm* — Bernard L. Kleinke; Duckor Spradling Metzger & Wynne

(57) ABSTRACT

A telescoping plumbing device and method is provided. The telescoping plumbing device and method may employ a flexible cable at least partially disposed within a plurality of nested pipes or tubes capable of being extended and retracted telescopically, so that the cable may be pushed down a toilet or drain by collapsing the plurality of pipes abruptly and forcibly from the extended position to the retracted position.

11 Claims, 5 Drawing Sheets

U.S. PATENT DOCUMENTS 4,622,702 A 11/1986 Allen
4,660,603 A 4/1987 Tash
4,672,988 A 6/1987 Tash
4,674,137 A 6/1987 Girse
4,733,414 A 3/1988 Wilkes
4,745,641 A 5/1988 Tash
4,756,480 A 7/1988 Fish
4,768,237 A 9/1988 Torti
4,825,900 A 5/1989 Tash
4,865,062 A 9/1989 Tash
4,895,178 A 1/1990 McHugh
4,957,123 A 9/1990 McHugh
4,986,311 A 1/1991 Mikkelson
5,020,166 A 6/1991 Davenport
5,056,177 A 10/1991 Nast
5,085,244 A 2/1992 Funk
5,107,550 A * 4/1992 Hawro ..... 4/255.08
5,125,425 A 6/1992 Folts et al.
5,199,114 A 4/1993 Christopher
5,239,708 A 8/1993 Irwin
5,253,664 A 10/1993 Wilson
5,276,934 A 1/1994 Brzoska
5,329,646 A 7/1994 Bevacco et al.
5,353,442 A 10/1994 Rotter
5,384,918 A 1/1995 Leighton et al.
5,497,514 A * 3/1996 Miller ..... 4/255.04
5,522,094 A 6/1996 Balazs
5,524,296 A 6/1996 Leighton
5,727,580 A 3/1998 Patterson
D404,178 S 1/1999 Wetzler
5,862,534 A 1/1999 Clay
5,915,846 A * 6/1999 Gillie ..... 4/255.01
6,055,680 A * 5/2000 Tolbert ..... 4/255.11
6,067,668 A * 5/2000 Rudd ..... 4/255.11
6,068,023 A 5/2000 Potter
6,163,895 A 12/2000 Davenport
6,286,172 B1 9/2001 Castagnoli
6,363,566 B1 4/2002 Collins
6,381,763 B1 5/2002 Schneider
6,412,136 B1 7/2002 Rutkowski
6,427,458 B1 8/2002 Fowler
6,775,857 B2 8/2004 Hughes, Jr. et al.
6,895,606 B2 5/2005 Walsh
6,934,975 B2 8/2005 Hope et al.
6,941,589 B1 9/2005 Dural et al.
7,146,674 B2 * 12/2006 Velez et al. ..... 15/104.05
2003/0230325 A1 * 12/2003 Barcay et al. ..... 134/146
2004/0064878 A1 4/2004 Walsh
2004/0133970 A1 7/2004 Gonzalez
2004/0181863 A1 9/2004 Hope et al.
2005/0172385 A1 8/2005 Jiang
2006/0096060 A1 5/2006 Zhang

* cited by examiner

TELESCOPING PLUMBING DEVICE AND METHOD

RELATED APPLICATION

The application claims priority to U.S. provisional patent application entitled TELESCOPING PLUMBING DEVICE AND METHOD, application No. 60/828,367, filed Oct. 5, 2006, and is incorporated herein by reference.

FIELD OF THE INVENTION

The present invention relates in general to a plumbing device. It more particularly relates to a telescoping plumbing device and method which may be used to facilitate the removal of a blockage in a toilet.

BACKGROUND ART

This section describes the background of the disclosed embodiment of the present invention. There is no intention, either express or implied, that the background art discussed in this section legally constitutes prior art.

Current devices utilized to remove blockages from toilets or drains are plungers, snake, and augers. Plungers are messy to use, do not always work properly and require a good seal to be effective, but few toilets and drains provide an area adequate for creating a good seal. The major problem in using a plunger is that it rarely, if ever, removes all or substantially all of the blockage, thereby leaving a toilet that may be partially blocked. Snakes and augers are more effective, but difficult to use due to the need to rotate the device and very messy to use due to this rotation. What is needed is a device for removing blockages from toilets and drains that is effective, easy to use, and not messy for the operator.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DESCRIPTION OF CERTAIN EMBODIMENTS OF THE INVENTION

Figure 1:
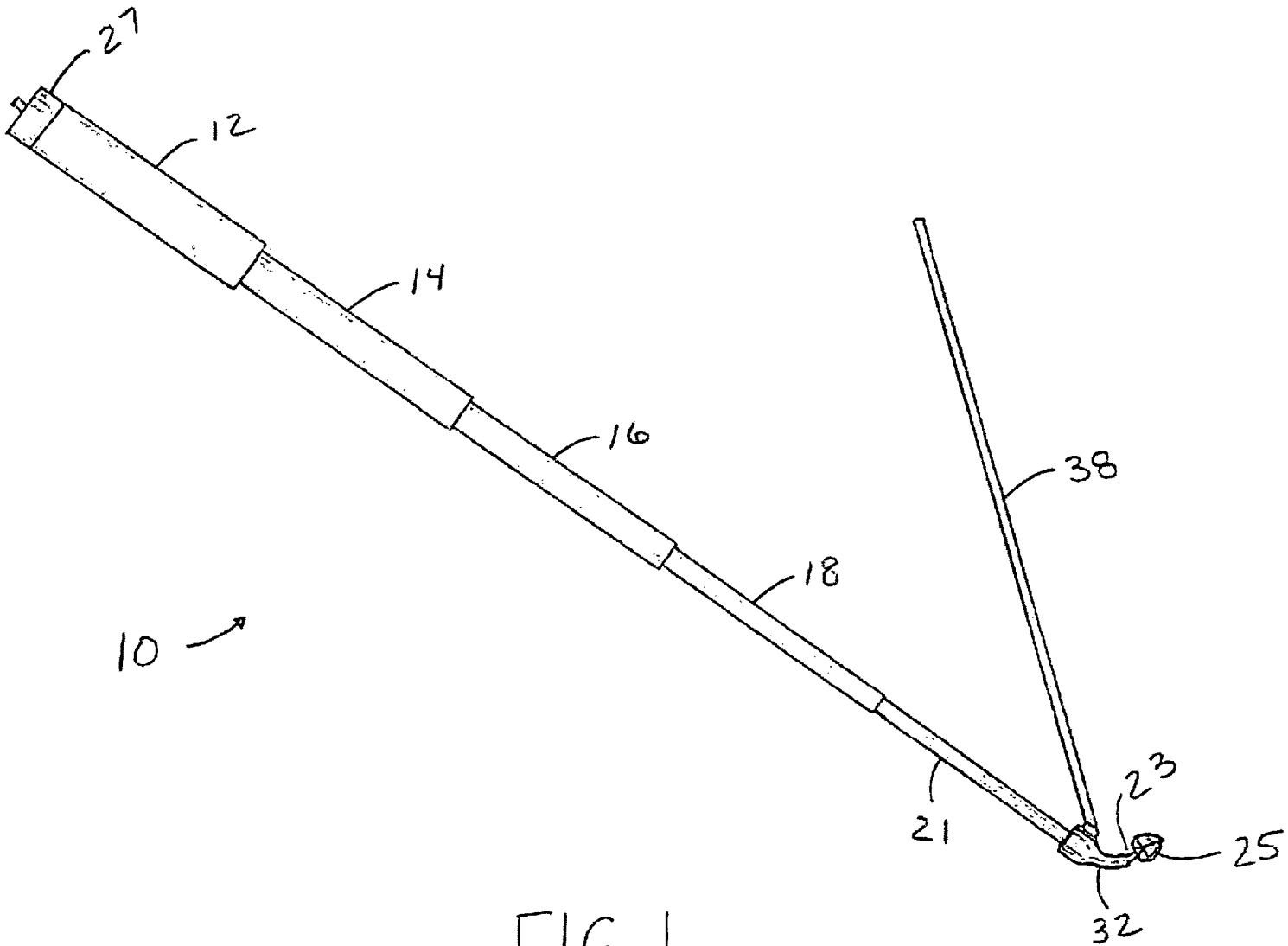
FIG. 1 is a pictorial view of an embodiment of a telescoping plumbing device in its expanded state according to the present invention.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

According to certain embodiments of the invention, there is provided a telescoping plumbing device and method employing a flexible cable at least partially disposed within a plurality of nested pipes or tubes capable of being extended and retracted telescopically, so that the cable may be pushed down a toilet drain by collapsing the plurality of pipes abruptly and forcibly from the extended position to the retracted position.

According to another embodiment of the invention, there is provided a device for removing a blockage from a toilet. The device may included a plurality of telescoping pipes, a cap at one end of the largest of the telescoping pipes, an insertion portion attached to one end of the smallest of the telescoping pipes, a flexible cable disposed at least partially within the telescoping pipes, a cable tip attached to a second end of the flexible cable for encountering the blockage and pushing it through the toilet, and a handle attached to the insertion portion for controlling the location of the insertion portion in the toilet drain. The flexible cable may include a first end attached to the cap and the second end extending out of the insertion portion. Furthermore, the flexible cable may be rotatable or non-rotatable about its axis.

According to yet another embodiment of the invention, there is provided a method of using a telescoping device having a flexible cable attached to a first end of the device and extending through a second end of the device for removing a blockage from a toilet. The method may include extending the telescoping device, inserting a cable tip attached to the flexible cable end and extending from the device into a neck at the bottom of a bowl of the toilet using a handle attached to the device and collapsing the telescoping device to force the cable tip through the neck of the toilet to the blockage for engaging the blockage and pushing it through the toilet.

According to still another embodiment of the invention, there is provided a device for removing a blockage from a toilet drain. The device may include a flexible cable having a first end and a second end, a cable tip attached to the first end of the flexible cable for encountering the blockage and pushing it through the toilet, and an insertion unit attached to the second end of the flexible cable and adapted to drive the cable tip and a portion of the flexible cable through the toilet drain to remove the blockage. The cable tip may include a pointed blunted end such as a pyramid-shaped tip portion having a blunt end, and a rounded bottom portion.

Figure 2:
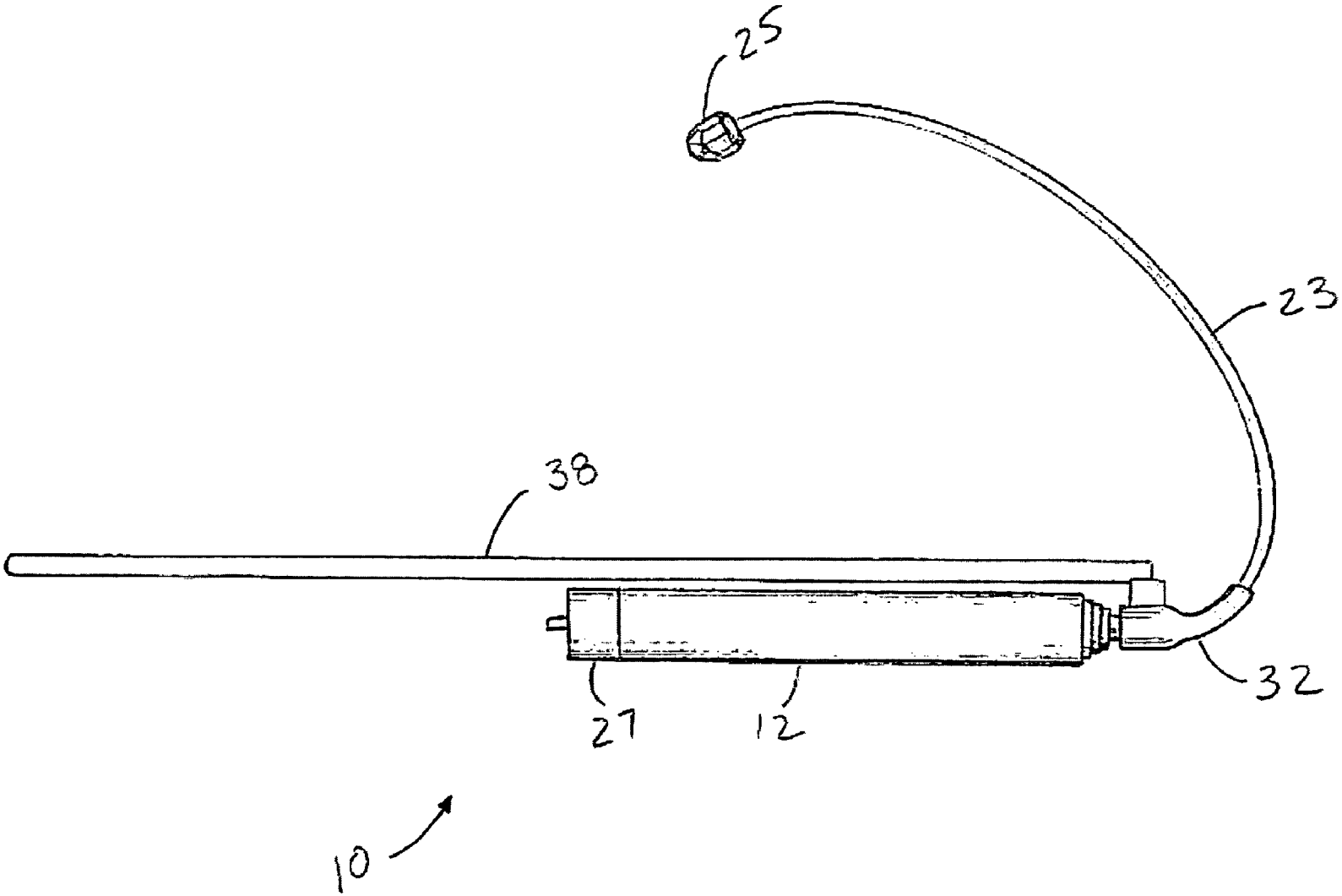
FIG. 2 is a pictorial view of the telescoping plumbing device of FIG. 1 in its contracted state.
Figure 3:
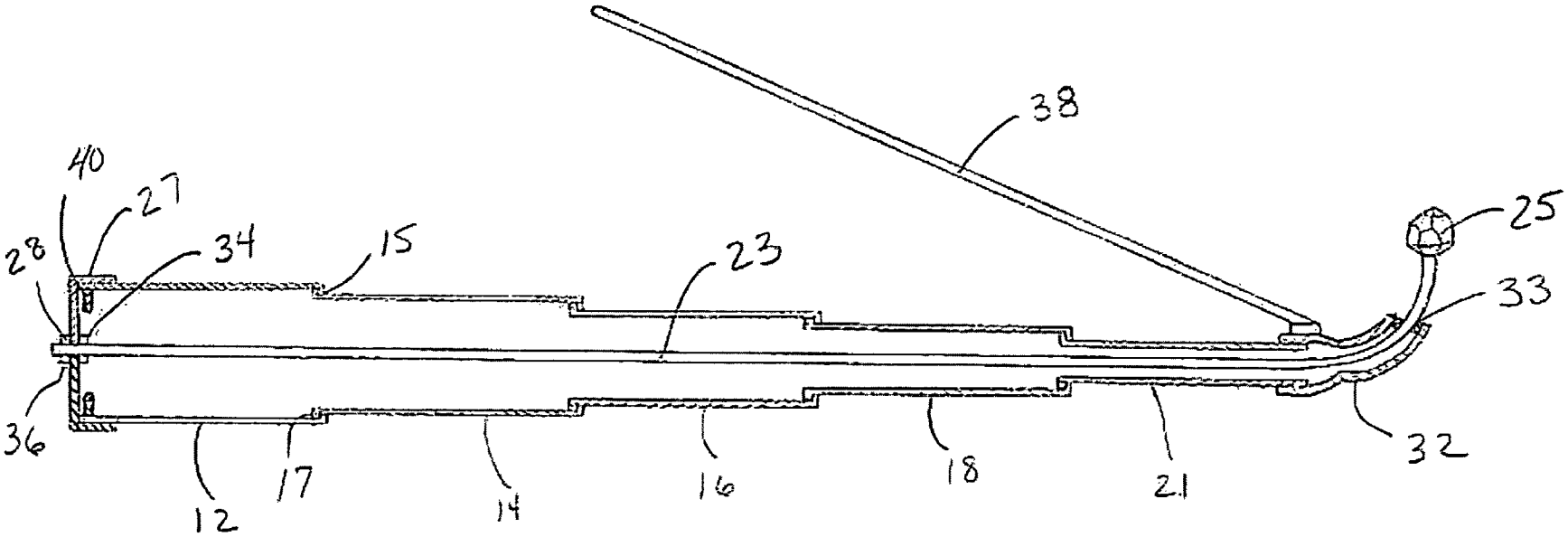
FIG. 3 is a side sectional view of the telescoping plumbing device of FIG. 1.

Referring now to the FIGS. 1-3, there is shown a telescoping plumbing device 10 for facilitating the removal of a blockage in a toilet drain (not shown) when the device 10 is abruptly pushed to its retracted position. The device 10 may be able to quickly and easily clear or at least substantially clear the blockage in a toilet drain without creating a mess or soiling the operator. In its retracted position, the overall axial length of the device is sufficiently short to be compact in size for storage purposes.

The device 10 may be generally a plurality of nested or telescoping pipes or tubes which may be expanded (FIG. 1) or retracted (FIG. 2) axially around a flexible cable 23 disposed within the pipes, to assist the cable in navigating through a toilet to help clear a drain line blockage. The device 10 may include a plurality of pipes or tubes 12, 14, 16, 18, and 21 having a variety of progressively larger diameter sizes such that the pipes fit within each other telescopically. For example, the inner diameter of the largest pipe 12 at the rear end of the device 10 may be slightly greater than the outer diameter of the second largest pipe 14. The inner diameter of pipe 14 may be slightly greater than the outer diameter of the middle pipe 16, and so on until the inner diameter of the second smallest pipe 18 may be slightly larger than the outer diameter of the smallest pipe 21 at the front end of the device 10. Each pipe may have a uniform circular cross section throughout its axial length.

As shown in FIG. 3, at each of the joints between adjoining pipes, retaining rings and bushings may be attached to either ends of each of the pipes to prevent separation of the pipes when expanding and contracting the telescoping plumbing device 10. Since all of the joints may be constructed similarly, only the joint between pipes 12 and 14 will be described in detail. A bushing 17 may be permanently attached to the inner surface of the end of the larger pipe 12, while a second bushing 15 may be permanently attached to the outer surface of the end of the smaller pipe 14. During expansion of the telescoping plumbing device 10, the bushings 15 and 17 may prevent the separation of the pipe 14 from the pipe 12. During contraction, internal retaining ring 40 prevents the inner pipe 14 from protruding beyond the end of the larger pipe 12. The internal retaining ring 40 is always attached to the top of the previous larger pipe 12. Each of the remaining joints at adjoining pipes may be constructed the same, with one bushing attached to the inner surface at the end of the larger of the two adjoining pipes, another bushing attached to the outer surface of the smaller of the two adjoining pipes and an internal retaining ring attached to the opposite end of the larger of the two adjoining pipes. Other methods of preventing separation of two adjoining pipes may also be utilized. Seals (not shown) may also be included at each of the joints between the adjoining pipes and at the end of the insertion tip 32 to prevent water or other material from getting inside of the telescoping plumbing device 10.

An insertion tip 32 may be securely fitted to the front end of the smallest pipe 21. The insertion tip 32 may be attached directly to the smallest pipe 21 or via one or more couplings (not shown). The coupling(s) may be in the form of a ring, and may include an internally threaded rear end to engage an externally threaded front end of the pipe 21. The insertion tip 32 may be approximately 3 to 4 inches in length and include a smoothly contoured bend to improve the insertion angle into the neck of a toilet drain (not shown). The angle of the bend may range from approximately 10 degrees to approximately 60 degrees. The length of each of the telescoping pipes may be approximately 11 inches, such that in an expanded position the pipes with the attached device tip may extend approximately 47 inches, and in a retracted position the pipes and the device tip may extend approximately 14 inches. An annular seal 33 is provided at the tip 32 surrounding the cable.

It should be understood that there may be a greater or fewer number of pipes. Also, the axial length of the pipes may vary, and thus, be greater or less than the presently preferred dimensions.

A centrally apertured cap 27 may be secured fixedly to the rear end of pipe 12. The cap 27 may include a hole 28 at its center for receiving a proximate or rear end of the flexible cable 23 using a pair of inner and outer locking nuts 34, 36 or other appropriate fastening means. The outer interlocking nut 36 may include a surface for attaching a drill (not shown) or other rotating device such as an electrical or mechanical motor (not shown) for rotating the flexible cable 23. The cable may be from about 3/16 inch to about 9/16 inch flexible cable.

The portion of the flexible cable 23 extending from the insertion tip 32 when the device is fully collapsed, may be approximately 22 to approximately 50 inches in length. The cable 23 extends axially through each of the hollow pipes and the insertion tip 32, such that the distal or front end portion of the cable 23 may extend outwardly from the tip 32 approximately 1 to approximately 50 inches from the insertion tip 32 depending on the respective extended/retracted position of the pipes. A length of approximately 36 inches may be the preferable length for the portion of the flexible cable 23 extending from the tip 32 when the device is fully collapsed. The flexible cable 23 may be rubber coated or covered with surgical tubing to prevent unwanted matter from attaching to the irregular surface of the cable to prevent unwanted matter from entering the interior of the pipes when used in conjunction with the seals at the joints of the device and to prevent the cable from scratching and damaging the interior surface of the toilet. The distal end of the cable 23 may also include a cable tip or dislodge member 25 that enables the cable and cable tip to navigate within the toilet drain with or without having to spin or rotate and for breaking or loosening up the blockage in the toilet drain.

A handle 38 may be attached solidly or hingedly to the end of the telescoping plumbing device 10 at or near the insertion device 32 and extend rearwardly toward the cap 27 and spaced from the pipes. The handle 38 may be from 12 to 30 inches in length to allow the operator to keep his or her hand out of the waste water in the toilet bowl (not shown). The handle 38 may include one or more sections constructed of either metal or plastic material and may provide a surface to attach to or wrap around the cable 23 when the device 10 is in the retracted position.

Figure 4:
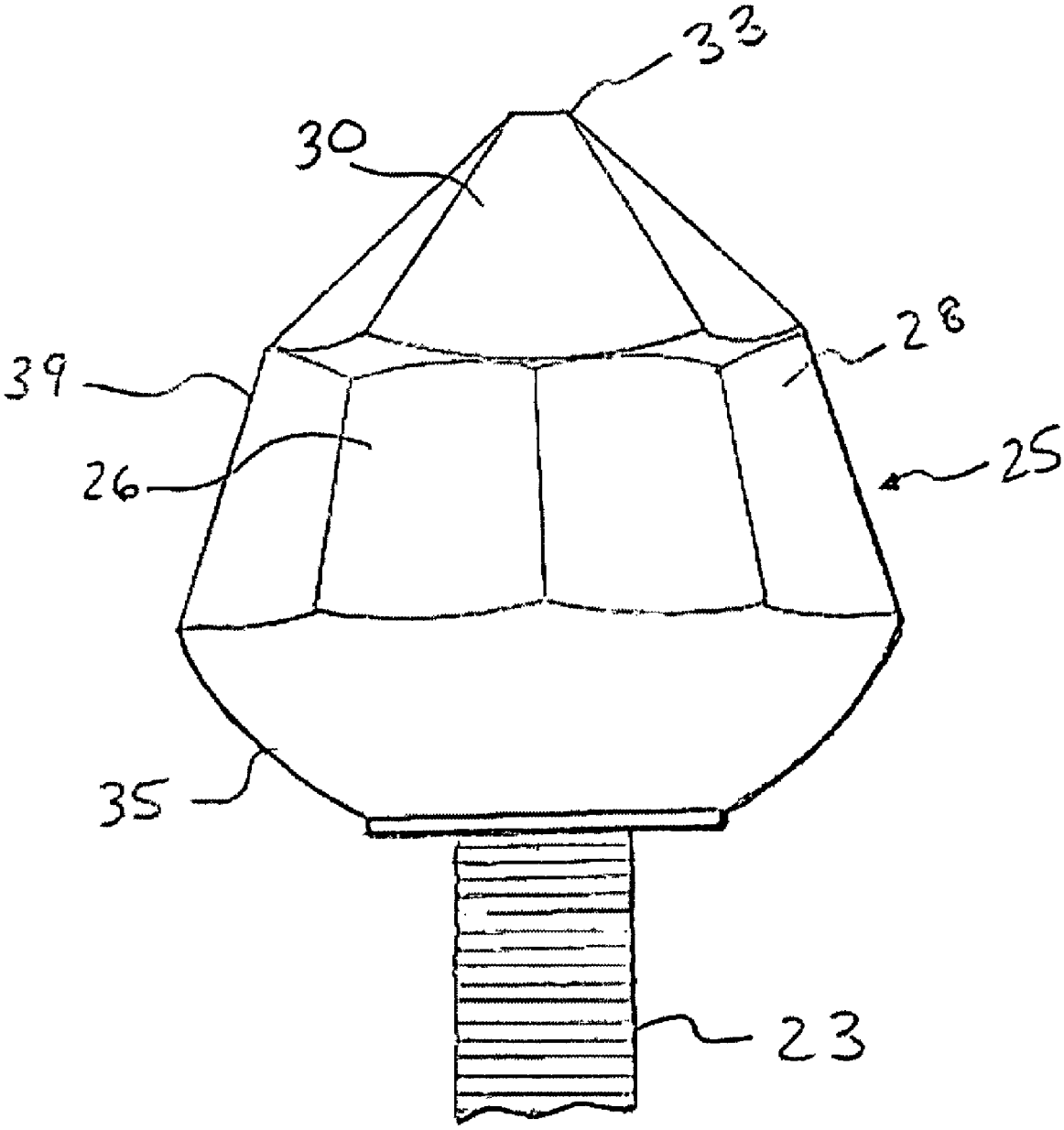
FIG. 4 is an enlarged fragmentary side view of the cable tip for the telescoping plumbing device of FIG. 1.
Figure 5:
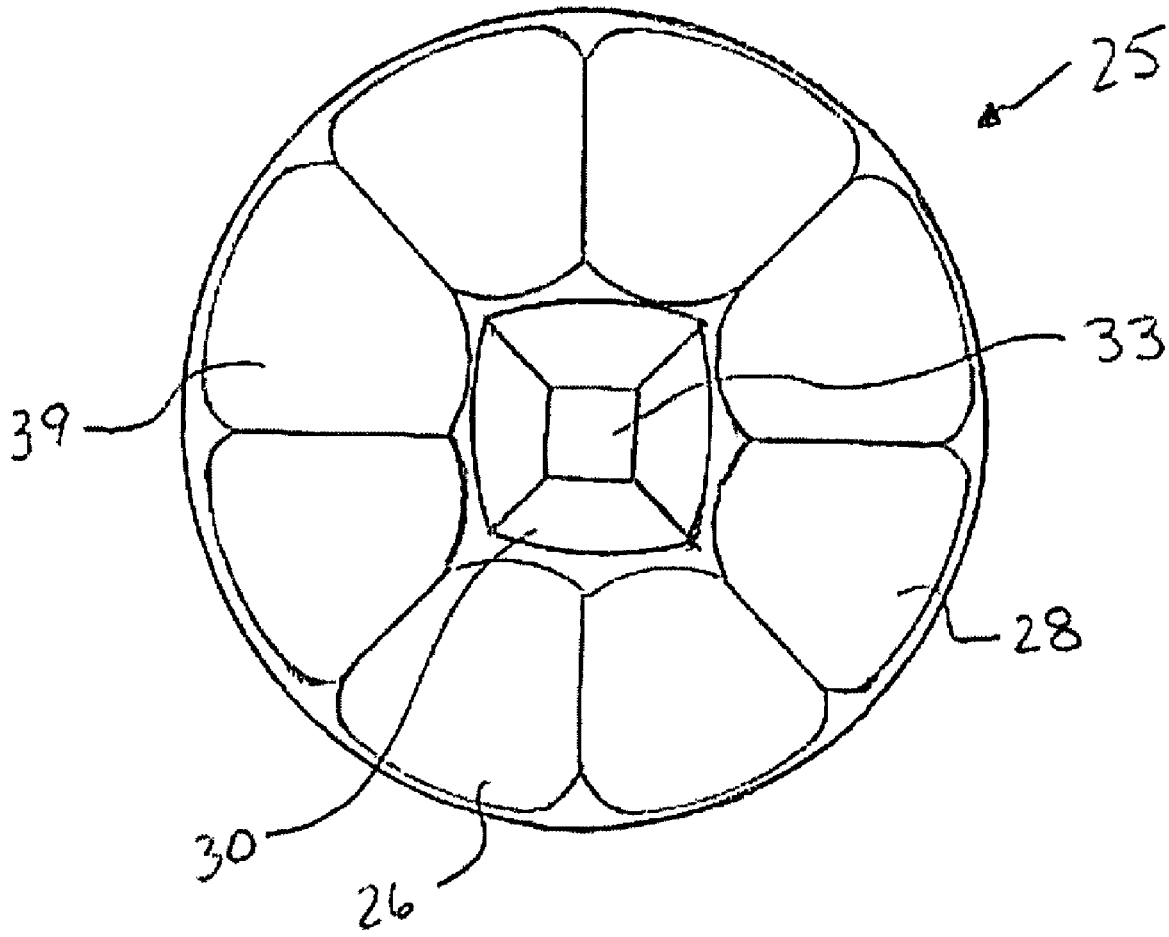
FIG. 5 is a top view of the cable tip of FIG. 4.

Referring now to FIGS. 4 and 5, the cable tip or dislodge member 25 may include a spherical cap or hemisphere having a diameter ranging from about 0.5 inch to about 1.5 inches to easily or readily navigate within the toilet drain. The range of the diameter of the cable tip 25 may preferably be between 0.75 and 1 inch. The cable tip 25 may include a pyramid-shaped tip portion 30 having a blunted end 33, an intermediate portion 39 being truncated conical shape and having a plurality of generally flat faces or facets, such as faces 26 and 28, and a rounded bottom portion 35. The tip portion 30 may also include a plurality of generally flat faces. The tip portion 30 and the intermediate portion 39 may facilitate the engaging of the blockage to allow the tip to break up or push the blockage through the toilet. The combined angles of the portions 30 and 39 may enable the cable and tip to assist in navigating through the toilet drain to the blockage with or without spinning or rotating. The blunted end 33 may prevent the cable tip 25 from initially punching a hole through the blockage and thus only partially unclog the drain. The bottom portion 35 may be rounded to help prevent the cable tip 25 from catching on any surface when being withdrawn from the toilet drain. The cable tip 25 may be weighted to help it push the blockage through the toilet. Other appropriate cable tips may also be used with the device 10.

To use the telescoping plumbing device 10, an operator may expand the telescoping device 10 into its fully extended position as shown in FIG. 1, with the flexible cable 23 and cable tip 25 extending a short distance of approximately 1-2 inches from the insertion tip 32. The operator may then grasp the handle 38 with one hand and guide the insertion tip 32 and cable tip 25 into the neck of the clogged toilet drain. While holding the insertion tip 32 and cable tip 25 into the neck of the clogged toilet (not shown), the operator may push down forcibly on the cap 27 or largest pipe 12 of the device 10 with the other hand to abruptly collapse the device 10 into its retracted position (FIG. 2) which pushes the cable 23 and cable tip 25 to the blockage in the toilet drain, thereby allowing the cable tip 25 to break up and/or push the blockage along the toilet line and allow the blockage to flow to the sewer. The operator may repeat this procedure several times quickly to insure that the blockage in the toilet drain is completely or at least substantially completely removed. The operator may then withdraw the fully extended device 10 including the cable 23 and cable tip 25 from the toilet drain, collapse the device 10 into its retracted position and attach the cable 23 to the handle 38 to place the device 10 in condition for storage.

It is envisioned that other embodiments of the telescoping plumbing device may include features, such as a spinner (not shown) attached to the cap of the device to rotate the cable when removing a clog that is difficult to dislodge (i.e. excessive amounts of compacted toilet paper or other substances), or a spring-type or other specifically designed cable tip to permit grabbing and removing the blockage, i.e., toy or other small object, from the drain. The spinner may be a battery operated motor (not shown), a mechanical wind-up motor (not shown), or other appropriate device. Furthermore, the end of the device may be fitted with a rubber grommet (not shown) for drains, instead of the insertion tip as illustrated. The rubber grommet may allow the operator to hold the tip of the device at the opening of the drain without slipping or scratching the surface of the drain.

The telescoping plumbing device may quickly and easily remove any naturally occurring blockage in toilet drains or pipes with little or no splashing or mess. This device may replace the plunger, drain cleaners, and any hand held pump unit or short windup snake.

Other uses of the device may be to remove items, such as toys, balls, jewelry, tools, or other small items, accidentally or unintentionally dropped into a toilet drain.

The words "approximately" or "about" shall mean that there may be plus or minus 20 percent tolerance.

While particular embodiments of the present invention have been disclosed, it is to be understood that various different embodiments are possible and are contemplated within the true spirit and scope of the appended claims. There is no intention, therefore, of limitations to the exact abstract or disclosure herein presented.

What is claimed is:

1. A toilet unclogging device for removing a blockage from a toilet drain, comprising:

a plurality of telescoping pipes;

a cap at one end of the largest of the telescoping pipes;

an insertion portion attached to one end of the smallest of the telescoping pipes;

the hollow insertion portion being an insertion tip having a smoothly contoured bend;

a flexible cable disposed at least partially within the telescoping pipes, attached at a first end to the cap, and having a second end extending through and out of the insertion portion;

a cable tip having a blunted pointed end and being attached to the second end of the flexible cable for encountering the blockage and pushing it;

wherein the cable tip is solid and includes a tip portion being pyramid-shaped and having a flat blunt end, the tip portion including a series of facets;

an intermediate portion being a truncated conical shape having a plurality of generally flat facets forming the truncated conical shape; and a rounded bottom portion; and a handle attached to the insertion portion for controlling the location of the insertion portion in the toilet.

2. The device according to claim 1, wherein the flexible cable is non-rotatable.

3. The device according to claim 1, wherein the flexible cable is rotatable.

4. The device according to claim 1, wherein each of the telescoping pipes is between about 8 to about 14 inches in length.

5. he device according to claim 1, wherein the plurality of telescoping pipes includes three to five pipes, each pipe having a length of about nine to fourteen inches.

6. The device according to claim 1, wherein the handle has a length of between about 12 to about 30 inches.

7. The device according to claim 1, wherein the cable tip has a diameter of between about 0.5 inch and about 1.5 inches.

8. The device according to claim 1, wherein the flexible cable has a length of between about 22 and about 50 inches.

9. The device according to claim 1, wherein the insertion portion is angled.

10. A device for removing a blockage from a toilet, comprising:

a flexible cable having a first end and a second end;

a cable tip attached to the first end of the flexible cable for encountering the blockage and pushing it through the toilet; and a smoothly-contoured bent hollow insertion unit attached to the second end of the flexible cable and adapted to drive the cable tip and a portion of the flexible cable through the toilet to remove the blockage, wherein the cable tip is solid and includes a tip portion being pyramid shaped and having a flat blunt end, the tip portion including a series of facets;

an intermediate portion being a truncated conical shape having a plurality of generally flat facets forming the truncated conical shape; and a rounded bottom portion.

11. The device according to claim 10, wherein the angle of the bend is between approximately 10 degrees and approximately 60 degrees.

* * * * *